US009913323B2

(12) United States Patent
Houbloss

(10) Patent No.: US 9,913,323 B2
(45) Date of Patent: Mar. 6, 2018

(54) DOOR FOR A MICROWAVE APPLIANCE

(71) Applicant: Electrolux Appliances Aktiebolag, Stockholm (SE)

(72) Inventor: Omar Houbloss, Plouzané (FR)

(73) Assignee: Electrolux Appliances Aktiebolag, Stockholm (SE)

( * ) Notice: Subject to any disclaimer, the term of this patent is extended or adjusted under 35 U.S.C. 154(b) by 136 days.

(21) Appl. No.: 14/758,886

(22) PCT Filed: Feb. 13, 2014

(86) PCT No.: PCT/EP2014/052770
§ 371 (c)(1),
(2) Date: Jul. 1, 2015

(87) PCT Pub. No.: WO2014/135347
PCT Pub. Date: Sep. 12, 2014

(65) Prior Publication Data

US 2016/0029442 A1 Jan. 28, 2016

(30) Foreign Application Priority Data

Mar. 4, 2013 (EP) ..... 13157617

(51) Int. Cl.
*H05B 6/76* (2006.01)
*H05B 6/64* (2006.01)
*F24C 15/04* (2006.01)

(52) U.S. Cl.
CPC ..... *H05B 6/763* (2013.01); *F24C 15/04* (2013.01); *H05B 6/6414* (2013.01); *H05B 6/766* (2013.01)

(58) Field of Classification Search
CPC ..... F24C 15/04; H05B 6/6414; H05B 6/6417; H05B 6/76; H05B 6/763; H05B 6/766
(Continued)

(56) References Cited

U.S. PATENT DOCUMENTS 3,678,238 A * 7/1972 Yasuoka ..... H05B 6/763 219/741
4,059,742 A * 11/1977 Baron ..... H05B 6/763 219/685
(Continued)

FOREIGN PATENT DOCUMENTS

CN 101796883 A 8/2010
DE 199 06 905 A1 8/2000
(Continued)

OTHER PUBLICATIONS

Office action and Search Report issued in corresponding Chinese Patent Application No. 201480004674.7 dated Dec. 2, 2016, 6 pages. English translation submitted herewith, 8 pages.
(Continued)

*Primary Examiner* — Sang Y Paik
(74) *Attorney, Agent, or Firm* — Pearne & Gordon LLP

(57) ABSTRACT

A door for a microwave appliance. The door includes an outer glass panel ranging over a complete outer side of the door and an inner glass panel ranging over at least a central portion of an inner side of the door. The door includes a door frame covering at least the circumferential sides of the oven door and a wave choke system. The outer glass panel, the inner glass panel and the door frame form a casing of the door, wherein the wave choke system is arranged inside the casing of the door. The wave choke system is arranged in an outer portion of the interior of the door and circumferentially enclosed by the door frame. The wave choke system is arranged adjacent to an outer side of the inner glass panel.

10 Claims, 2 Drawing Sheets

(58) Field of Classification Search
USPC ..... 219/736–743
See application file for complete search history.

(56) References Cited

U.S. PATENT DOCUMENTS

| | | | | |
|---|---|---|---|---|
| 4,211,910 | A * | 7/1980 | Kusunoki | H05B 6/766 174/359 |
| 4,711,982 | A | 12/1987 | Millman | |
| 5,036,171 | A * | 7/1991 | Kim | H05B 6/763 174/363 |
| 2005/0205564 | A1 | 9/2005 | Stahli | |

FOREIGN PATENT DOCUMENTS

| | | | |
|---|---|---|---|
| DE | 10 2004 003 406 | A1 | 8/2005 |
| EP | 2 031 938 | A1 | 3/2009 |
| GB | 2 187 617 | A | 9/1987 |
| GB | 2187617 | A | 9/1987 |

OTHER PUBLICATIONS

International Search Report issued in Application No. PCT/EP2014/052770 dated May 26, 2014.
CN OA for application 201480004674.7, dated Jun. 28, 2017, 9 pages. Original in Chinese and English translation.

* cited by examiner

DOOR FOR A MICROWAVE APPLIANCE

The present invention relates to a door for a microwave appliance. In particular, the present invention relates to an oven door for a microwave oven or a multifunctional oven with microwave heating function. Further, the present invention relates to a microwave appliance. Moreover, the present invention relates to a microwave oven or a multifunctional oven with microwave heating function.

In a microwave appliance the leakage between a door and an opening has to be minimized. For this purpose, a wave choke system is arranged in the outer portions inside the door. The dimensions of the wave choke system result in a small window in the central portion of the door. In a similar way, the dimensions of a door frame made of plastics also contribute to the small window in the door. Said small window limits the view into the inner space of the microwave appliance.

OBJECTS OF THE INVENTION

It is an object of the present invention to provide a door for a microwave appliance, which allows an improved view into the inner space of the microwave appliance.

The object of the present invention is achieved by the door for a microwave appliance according to claim 1.

The present invention relates to a door for a microwave appliance, wherein:

- the door includes an outer glass panel ranging over a complete outer side of the door,
- the door includes an inner glass panel ranging over at least a central portion of an inner side of the door,
- the door includes a door frame covering at least the circumferential sides of the oven door,
- the door includes a wave choke system,
- the outer glass panel, the inner glass panel and the door frame form a casing of the door,
- the wave choke system is arranged inside said casing of the door,
- the wave choke system is arranged in an outer portion of the interior of the door and circumferentially enclosed by the door frame,
- the wave choke system is arranged adjacent to an outer side of the inner glass panel, and
- the circumferential sides of the inner glass panel are enclosed by the door frame.

SUMMARY OF THE INVENTION

The main idea of the present invention is that the outer glass panel ranges over the complete outer side of the door on the one hand and the inner glass panel ranges over the substantially complete inner side of the door on the other hand. The circumferential sides of the door are covered by the door frame. Additionally, the outer portions of the inner side of said door are also covered by the door frame. Thus, the outer glass panel, the inner glass panel and the door frame form the casing of the door, wherein the wave choke system is arranged inside said casing. The door has a compact form with smooth surfaces. Since the wave choke system is adjacent to the outer side of the inner glass panel, said inner glass panel is relative large and the door allows an improved view through said door into a cavity of the microwave appliance.

According to preferred embodiment of the present invention the door frame is made of plastics.

Further, at least one intermediate glass panel may be arranged between the wave choke system and the outer glass panel.

According to a preferred embodiment of the present invention the wave choke system includes a G-shaped profile.

In particular, the wave choke system includes at least one lamellae structure.

For example, the lamellae structure is arranged beside a gap of the G-shaped profile of the wave choke system.

Preferably, the lamellae structure is arranged adjacent to an outer side of the inner glass panel. The inner glass panel may have a relative high thickness.

Further, a gap between the circumferential sides of the inner glass panel and the door frame may be filled by a gasket. This contributes to a smooth surface of the door.

Moreover, a bending up of the wave choke system penetrates at least partially into the gap between the circumferential sides of the inner glass panel and the door frame.

In particular, the door is an oven door for a microwave oven.

Further, the present invention relates to a microwave appliance, wherein said microwave appliance includes at least one door mentioned above.

For example, the microwave appliance is a microwave oven.

Preferably, the microwave appliance comprises a cavity and a front frame, wherein the front frame encloses circumferentially a front opening of the cavity.

Furthermore, a gap between the front frame and the front opening of the cavity is filled by a gasket.

At last, the wave choke system of the door may extend in parallel to the gap between the front frame and the front opening of the cavity in a closed state of said door Novel and inventive features of the present invention are set forth in the appended claims.

BRIEF DESCRIPTION OF THE DRAWINGS

The present invention will be described in further detail with reference to the drawings, in which.

DETAILED DESCRIPTION OF THE INVENTION

Figure 1:
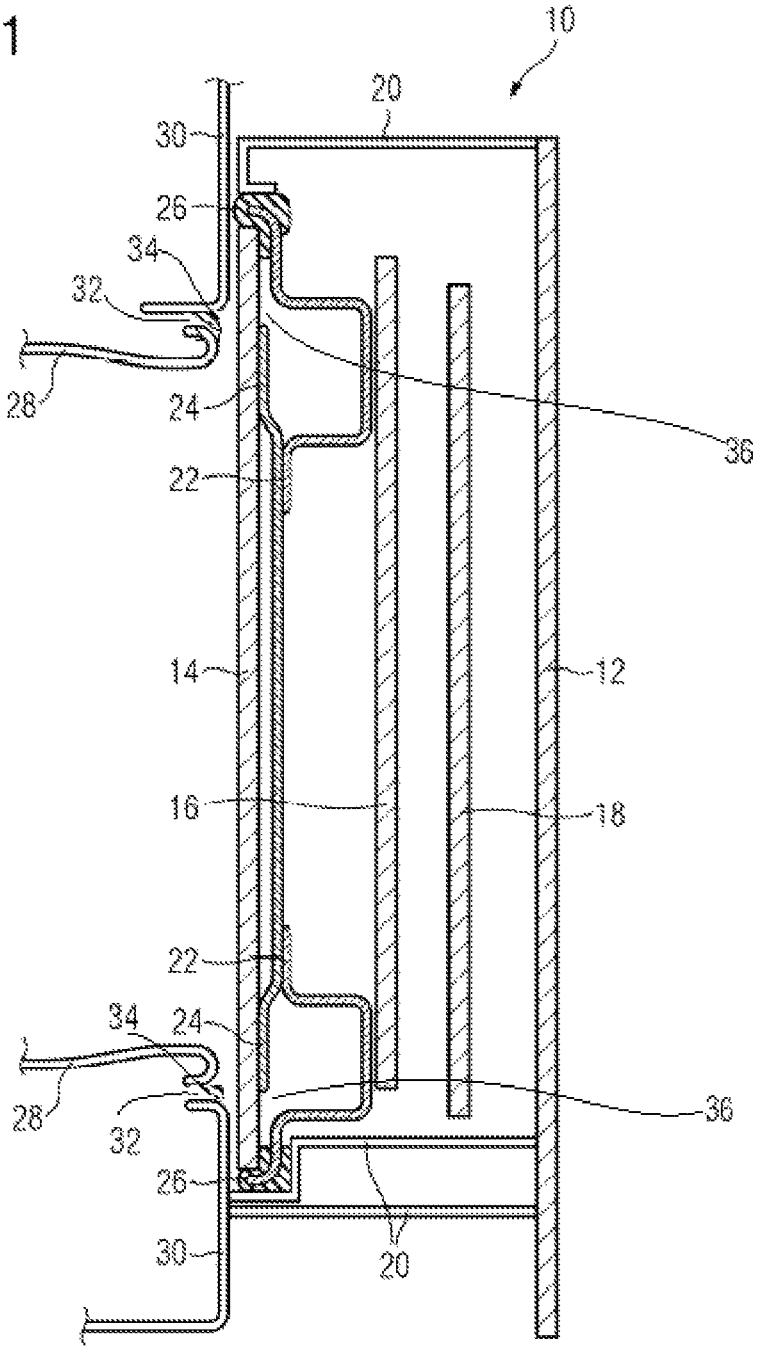
FIG. 1 illustrates a schematic sectional side view of an oven door for a microwave oven or a multifunctional oven with microwave heating function according to a preferred embodiment of the present invention.

FIG. 1 illustrates a schematic sectional side view of an oven door 10 for a microwave oven or a multifunctional oven with microwave heating function according to a preferred embodiment of the present invention. The oven door 10 is attached at a microwave oven. In FIG. 1 the oven door 10 is in a closed state.

The oven door 10 comprises an outer glass panel 12, an inner glass panel 12, a first intermediate glass panel 16, a second intermediate glass panel 18, a door frame 20 and a wave choke system 22. The microwave oven includes an oven cavity 28 and a front frame 30.

A gap 32 between the front frame 30 and the front opening of the cavity 28 is filled by a second gasket 34.

The outer glass panel 12 forms the outer side of the oven door 10 and is attached at the door frame 20. The area of the outer glass panel 12 is bigger than that area spanned by the door frame 20. Thus, the outer glass panel 12 covers completely the door frame 20. The inner glass panel 12 forms the substantial part of the inner side of the oven door 10. The circumferential sides of the inner glass panel 12 are enclosed by the door frame 20. In this example, the door frame 20 is made of plastics. The door frame 20 may either be formed as a single-piece part or composed by several frame parts. The wave choke system 22 is made of metal sheets.

The wave choke system 22, the first intermediate glass panel 16 and the second intermediate glass panel 18 are arranged between the outer glass panel 12 and the inner glass panel 12. The wave choke system 22 is adjacent to the outer side of the inner glass panel 12. The first intermediate glass panel 16 is arranged in front of the wave choke system 22. In turn, the second intermediate glass panel 18 is arranged in front of the first intermediate glass panel 16. The door frame encloses circumferentially also the wave choke system 22, the first intermediate glass panel 16 and the second intermediate glass panel 18.

The wave choke system 22 includes a G-shaped profile extending in parallel to the front frame 30 of the microwave oven. The G-shaped profile forms a rectangular frame enclosed by the door frame 20. A gap 36 of the G-shaped profile extends in parallel to a gap 32 between the oven cavity 28 and the front frame 30 of the microwave oven. A profile section besides the gap 36 of the G-shaped profile includes a lamellae structure 24. The lamellae structure 24 is adjacent to the outside inside of the inner glass panel 14. The plane of the lamellae structure 24 extends in parallel to the inner glass panel 14.

A circumferential gap between the inner glass panel 14 and the door frame 20 is filled by a first gasket 26. Further, the first gasket 26 encloses partially a bending up of the wave choke system 22. Said bending up encloses the wave choke system 22 and penetrates partially into the gap between the inner glass panel 14 and the door frame 20.

Figure 2:
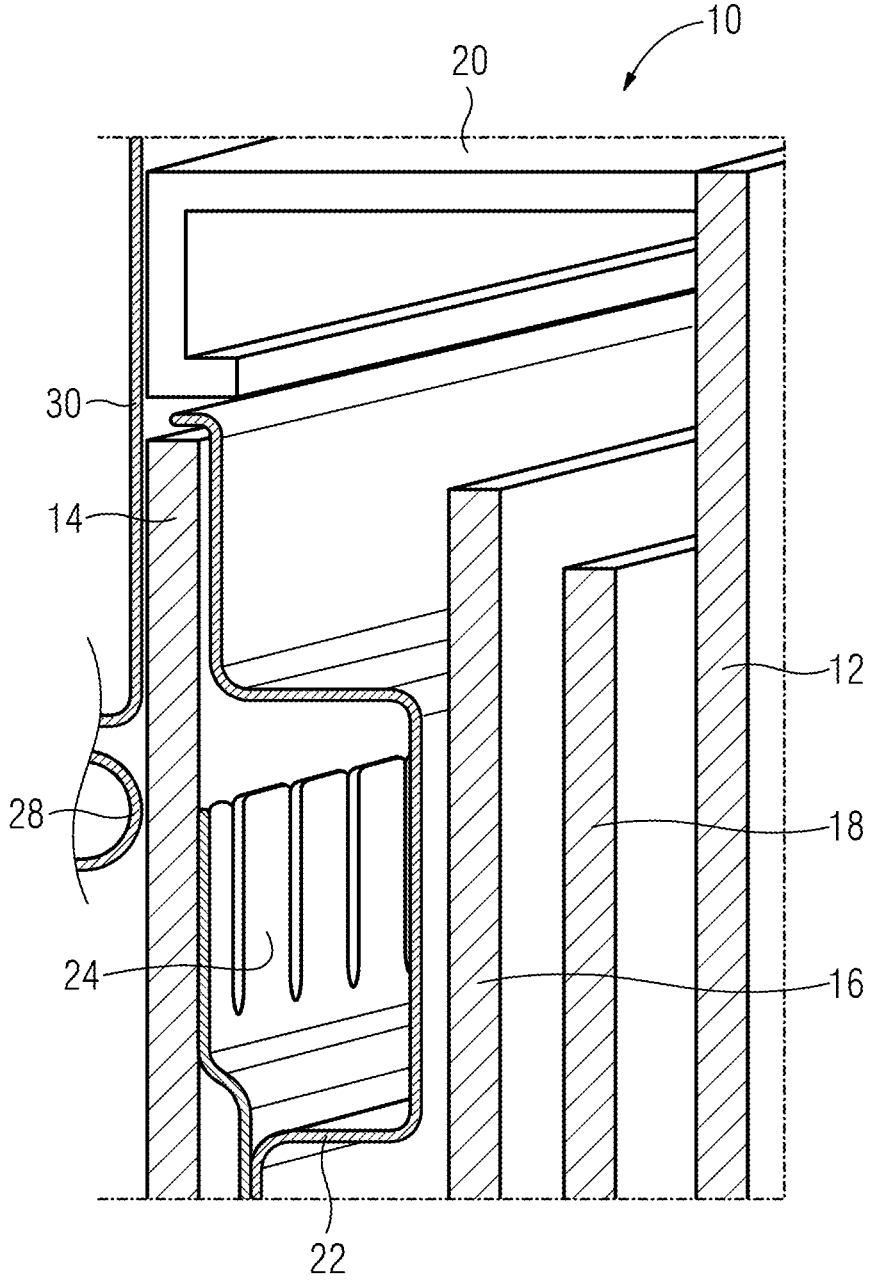
FIG. 2 illustrates a schematic sectional perspective view of an upper part of the oven door for the microwave oven or multifunctional oven with microwave heating function according to the preferred embodiment of the present invention.

FIG. 2 illustrates a schematic sectional perspective view of an upper part of the oven door 10 for the microwave oven or the multifunctional oven with microwave heating function according to the preferred embodiment of the present invention.

In particular, FIG. 2 shows the geometric properties of the wave choke system 22 including the lamellae structure 24. Further, the arrangements of the outer glass panel 12, the inner glass panel 12, the first intermediate glass panel 16, the second intermediate glass panel 18 and the door frame 20 are shown. For clarity, the first gasket 26 is not shown in FIG. 2.

The oven door 10 allows an improved view through said oven door 10 into the oven cavity 28. The oven door 10 has a compact form with smooth surfaces. Since the inner glass panel 14 ranges over the nearly complete inner side of the oven door 10, said inner side may be cleaned up in an easy way. The oven door 10 allows a leakage below 1 $mW/cm^2$. This value results from the structure and profile of the wave choke system 22.

The present invention is not restricted to the oven door 10 for the microwave oven. In general, the present invention relates to a door for a microwave appliance and a corresponding microwave appliance.

Although an illustrative embodiment of the present invention has been described herein with reference to the accompanying drawings, it is to be understood that the present invention is not limited to that precise embodiment, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven door
12 outer glass panel
14 inner glass panel
16 first intermediate glass panel
18 second intermediate glass panel
20 door frame
22 wave choke system
24 lamellae structure
26 first gasket
28 oven cavity
30 front frame
32 gap between the front frame and the cavity
34 second gasket
36 gap of the G-shaped profile

What is claimed is:

1. A microwave appliance comprising:
a cavity (28) with a front opening and cavity walls;
a front frame (30) enclosing circumferentially the front opening;
a first gap (32) between the front frame (30) and the cavity walls; and
a door (10) comprising:
an outer glass panel (12) ranging over a complete outer side of the door (10),
an inner glass panel (14) ranging over at least a central portion of an inner side of the door (10),
a door frame (20) covering at least the circumferential sides of the door (10),
a wave choke system (22) with a G-shaped profile,
the outer glass panel (12), the inner glass panel (14) and the door frame (20) forming a casing of the door (10),
the wave choke system (22) being arranged inside said casing of the door (10),
the wave choke system (22), being circumferentially enclosed by the door frame (20),
the circumferential sides of the inner glass panel (14) being enclosed by the door frame (20), and
a second gap (36) of the G-shaped profile of the wave choke system extending in parallel to the first gap (32) between the front frame (30) and the cavity walls in a closed state of said door (10).

2. The microwave appliance according to claim 1, wherein
the door frame (20) is made of plastics.

3. The microwave appliance according to claim 1, wherein
at least one intermediate glass panel (16, 18) is arranged between the wave choke system (22) and the outer glass panel (12).

4. The microwave appliance according to claim 1,
the wave choke system (22) including at least one lamellae structure (24).

5. The microwave appliance according to claim 4,
the lamellae structure (24) being arranged beside the second gap (36) of the G-shaped profile of the wave choke system (22).

6. The microwave appliance according to claim 4, the lamellae structure (24) being arranged adjacent to an inner side of the inner glass panel (14).

7. The microwave appliance according to claim 1, wherein a third gap between the circumferential sides of the inner glass panel (14) and the door frame (20) is filled by a first gasket (26).

8. The microwave appliance according to claim 1, wherein a bending up of the wave choke system (22) penetrates at least partially into a third gap between the circumferential sides of the inner glass panel (14) and the door frame (20).

9. The microwave appliance according to claim 1, wherein the first gap (32) between the front frame (30) and the cavity (28) is filled by a second gasket (34).

10. A multifunctional appliance with a conventional oven heating function and a microwave heating function, said appliance comprising:

a cavity (28) with a front opening and cavity walls;

a front frame (30) enclosing circumferentially the front opening;

a first gap (32) between the front frame (30) and the cavity walls; and a door (10) comprising:

an outer glass panel (12) ranging over a complete outer side of the door (10), an inner glass panel (14) ranging over at least a central portion of an inner side of the door (10), a door frame (20) covering at least the circumferential sides of the door (10), a wave choke system (22) with a G-shaped profile, the outer glass panel (12), the inner glass panel (14) and the door frame (20) forming a casing of the door (10), the wave choke system (22) being arranged inside said casing of the door (10), the wave choke system (22), being circumferentially enclosed by the door frame (20), the circumferential sides of the inner glass panel (14) being enclosed by the door frame (20), and a second gap (36) of the G-shaped profile of the wave choke system extending in parallel to the first gap (32) between the front frame (30) and the cavity walls in a closed state of said door (10).

* * * * *